United States Patent [19]

Terzian et al.

[11] 4,159,665

[45] Jul. 3, 1979

[54] MUSICAL TOY

[75] Inventors: Rouben T. Terzian, Chicago; Burton C. Meyer, Downers Grove, both of Ill.

[73] Assignee: Marvin Glass & Associates, Chicago, Ill.

[21] Appl. No.: 872,427

[22] Filed: Jan. 26, 1978

[51] Int. Cl.[2] ..... G10D 13/08

[52] U.S. Cl. ..... 84/404; 46/175 R; 46/191

[58] Field of Search ..... 84/404, 402, 403, 405; 46/175 R, 189, 191

[56] References Cited

U.S. PATENT DOCUMENTS

| | | | |
|---|---|---|---|
| 2,478,549 | 8/1949 | Samet | 84/404 |
| 2,541,143 | 2/1951 | Zimmerman | 84/404 |
| 2,898,796 | 8/1959 | Lohr et al. | 84/404 |
| 3,533,323 | 10/1970 | Baxter | 84/404 X |
| 3,673,909 | 7/1972 | Birnkrant | 84/404 X |
| 3,761,598 | 9/1973 | Haile | 84/404 X |
| 3,800,652 | 4/1974 | Shubeck | 84/404 |

FOREIGN PATENT DOCUMENTS

| | | | |
|---|---|---|---|
| 349392 | 5/1931 | United Kingdom | 84/404 |

*Primary Examiner*—Lawrence R. Franklin
*Attorney, Agent, or Firm*—Mason, Kolehmainen, Rathburn & Wyss

[57] ABSTRACT

A musical toy includes a first housing in which musical tone bars are mounted. A striking instrument rotatably mounted within a second housing and rotatably coupled to a motor for selection actuation to strike a selected musical bar. The second housing is pivotally connected to the first housing to allow the striking instrument to be positioned over a selected musical bar to produce a desired musical note.

8 Claims, 5 Drawing Figures

2

3

10
12
14
16
18
20
28
30
34
36
38
40
68R
68L
2

2
3
4
5
12
14
16
18
20
22
24
26
30
34
36
38
40
42
44a
45
46
48
56
58
60
62
64
66
67
67a 36
38
68R
68L
58
60
56
43
54
52
70
55
45
30
46
50
42
44a
44
48
A
20
22
24
26
34
12
14
16
18
28
67
40
2

MUSICAL TOY

BACKGROUND OF THE INVENTION

A. Field of the Invention

The device of the present invention relates to a new and improved musical toy.

B. Description of the Prior Art

Musical toys provide both pleasure and a learning experience for small children. Typical musical toys provide entertainment for the child by producing musical notes, and in addition, provide a learning instrument in that the child may use the toy to produce different notes and combine these notes in a song.

One desirable feature that must be accomplished with musical toys for small children is that the toy must be both attractive to the child and of an interesting configuration. In addition, the musical toy must also be easily operated by the child to produce the desired music.

SUMMARY OF THE INVENTION

An object of the present invention is to provide a new and improved musical toy.

Another object of the present invention is to provide a new and improved musical toy that is attractive and easily operated by a child.

The present invention is directed to a new and improved musical toy for use by young children that is attractive to the child and easily operated. The musical toy includes a set of musical tone bars that each produce a musical note upon being struck. The bars are mounted within a housing which may include a decorative and appealing design.

In order to strike individual bars to provide a musical note a striker assembly is provided. The striker assembly is mounted in a body portion having a configuration that is appealing to a child.

The striker assembly includes a selectively actuable motor to rotate the striker. The striker assembly body is pivotally connected to the housing of the tone bars such that the striker is selectively movable relative to the tone bars to position the striker above a selected tone bar. In this position, the striker may be selectively rotated such that it strikes the selected bar producing a musical note.

BRIEF DESCRIPTION OF THE DRAWINGS

The above and other objects and advantages and novel features of the present invention will become apparent from the following detailed description of a preferred embodiment of the invention illustrated in the accompanying drawings, wherein.

DETAILED DESCRIPTION OF A PREFERRED EMBODIMENT

Figure 1:
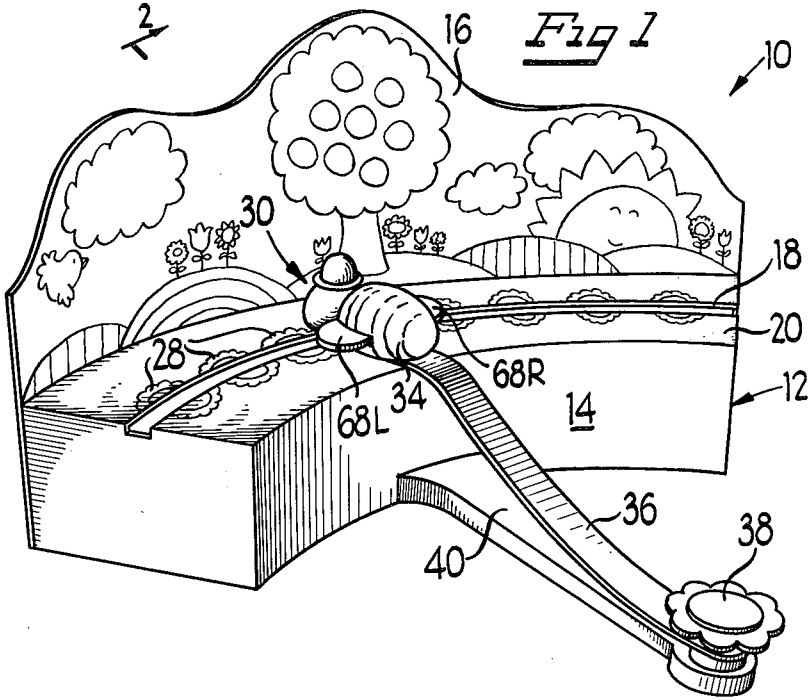
FIG. 1 is a perspective view of a musical toy constructed in accordance with the principles of the present invention.

Referring now to the drawings and initially to FIG. 1, there is illustrated a musical toy generally designated by the reference numeral 10. The musical toy 10 includes a first housing generally designated by the reference numeral 12 that includes a lower arcuate box portion 14 for enclosing a set of musical bars and a back wall portion 16 on which a desirable graphic such as outdoor scenery may be provided. The box portion 14 includes a curvilinear slot 18 defined on its top wall 20.

Mounted within the box portion 14 and directly below the slot or opening 18 are a plurality of tone bars 22 positioned at a plurality of locations along the horizontal length of the box portion 14. The musical bars 22 are mounted by a support frame 24 on pads or cushions 26 that allow the tone bar 22 to vibrate at a specific frequency to produce a predetermined musical note upon being struck. A plurality of flowers or similar graphics 28 are defined on the top wall 20 of the box 14, each of which are located directly above an associated tone bar 22 to indicate the position of the tone bar.

Figure 2:
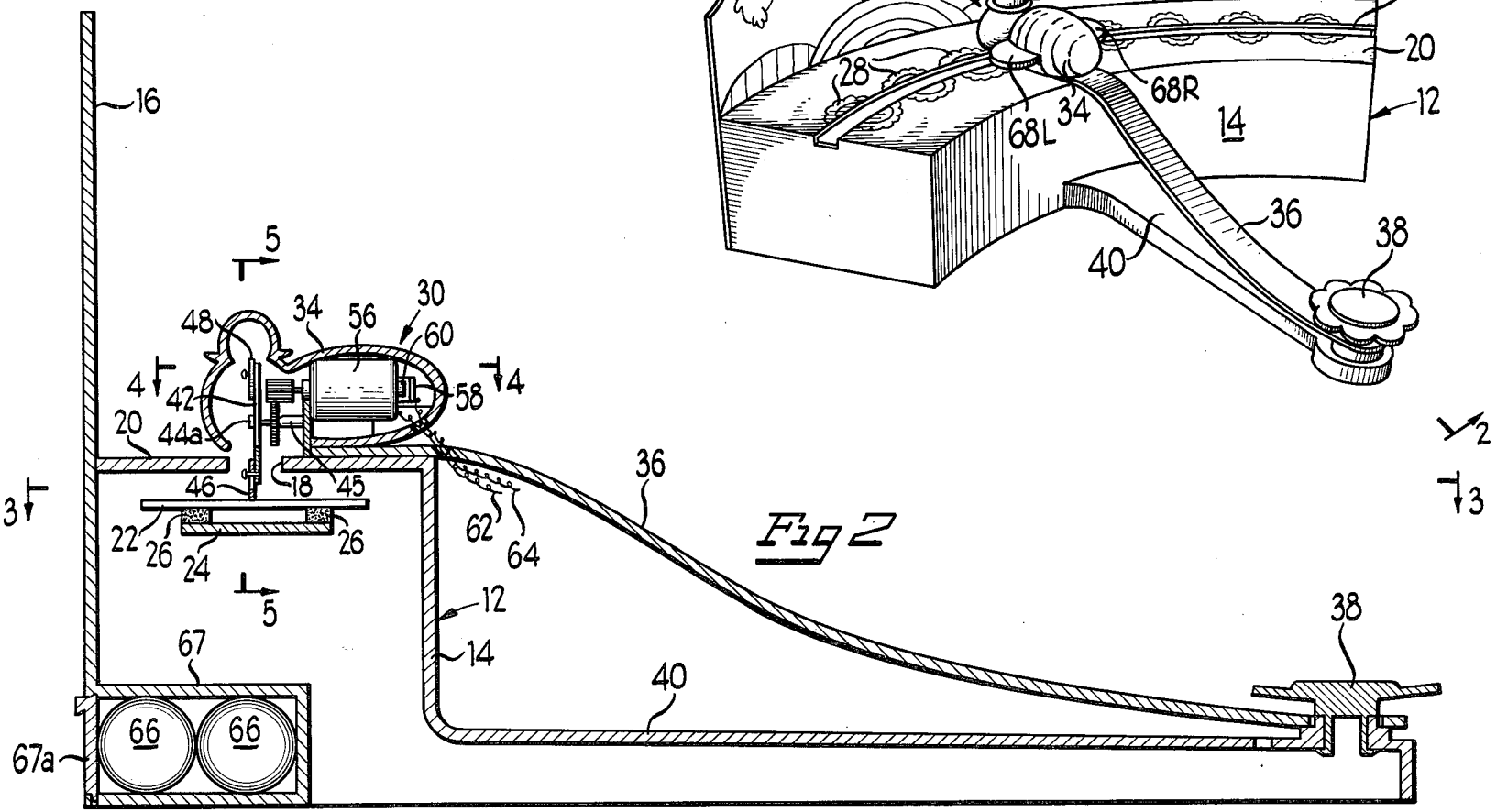
FIG. 2 is an enlarged, vertical cross-sectional view taken along line 2—2 in FIG. 1.

Means are provided for striking the bars 22 to produce a musical note or various combinations in sequence. In the preferred embodiment this includes a striker assembly generally designated by the reference numeral 30 (FIG. 2). The striker assembly 30 includes a body or housing 34 which may be constructed of any desired configuration. In the preferred embodiment, the illustrated configuration of the body 34 is formed in the shape to resemble a bumble bee which complies with the general theme of the flowers 28 on the top wall 20.

The housing or body 34 is secured to a pivot arm or beam 36 which is pivotally secured by a pivot pin 38 to a generally horizontally extended housing member 40 at the midpoint of the housing wall. As illlustrated in the preferred embodiment, the pivot pin 38 is of the design of a flower in accordance with the general theme of the toy 10. The body 34 and striker assembly 30 may be selectively manually pivoted to a desired position relative to the top wall 20 and positioned above any selected tone bar 22.

The striker assembly 30 includes a rotatable striker arm or bar 42 mounted on a midbody flange 43 by a rotatable shaft 44. The shaft 44 is mounted by a bushing 45 on the flange 43 and the striker arm 42 is secured to the end of the shaft 44 by an enlarged flattened end 44*a*. Means for striking the tone bars 22 is provided at opposite ends of the bar 42 in the form of washers 46 and 48 mounted by pins or rivets 50. The apertures in the washers 46 and 48 are larger than the heads of the rivets 50 so that the washers are loosely mounted on the pin to permit movement relative to the striker arm 42 and rivets 50 upon striking a tone bar 22.

The arm 42 and the washers 46 and 48 are secured by the shaft 44 to a driven gear 52, mounted rearwardly thereof. The driven gear 52 is in meshing engagement with a pinion gear 54 secured to the end of a motor shaft 55. A motor 56 or other selectively actuable drive means is mounted to the flange 43 within the body 34 so that the pinion gear 54 engages the driven gear 52 on the shaft 44. The motor 56 includes a pair of electrical contacts, 58 and 60, which define an off-on control switch. In the normal unbiased position, the contacts 58 and 60 are out of contact with one another. The contacts 58 and 60 are electrically connected in series by wires 62 and 64 to a pair of batteries 66 (FIG. 2) mounted within a battery housing 67 at the lower rear extremity of the housing 12. An access door 67*a* facilitates removal and replacement of the batteries 66.

Figures 3, 4, 5:
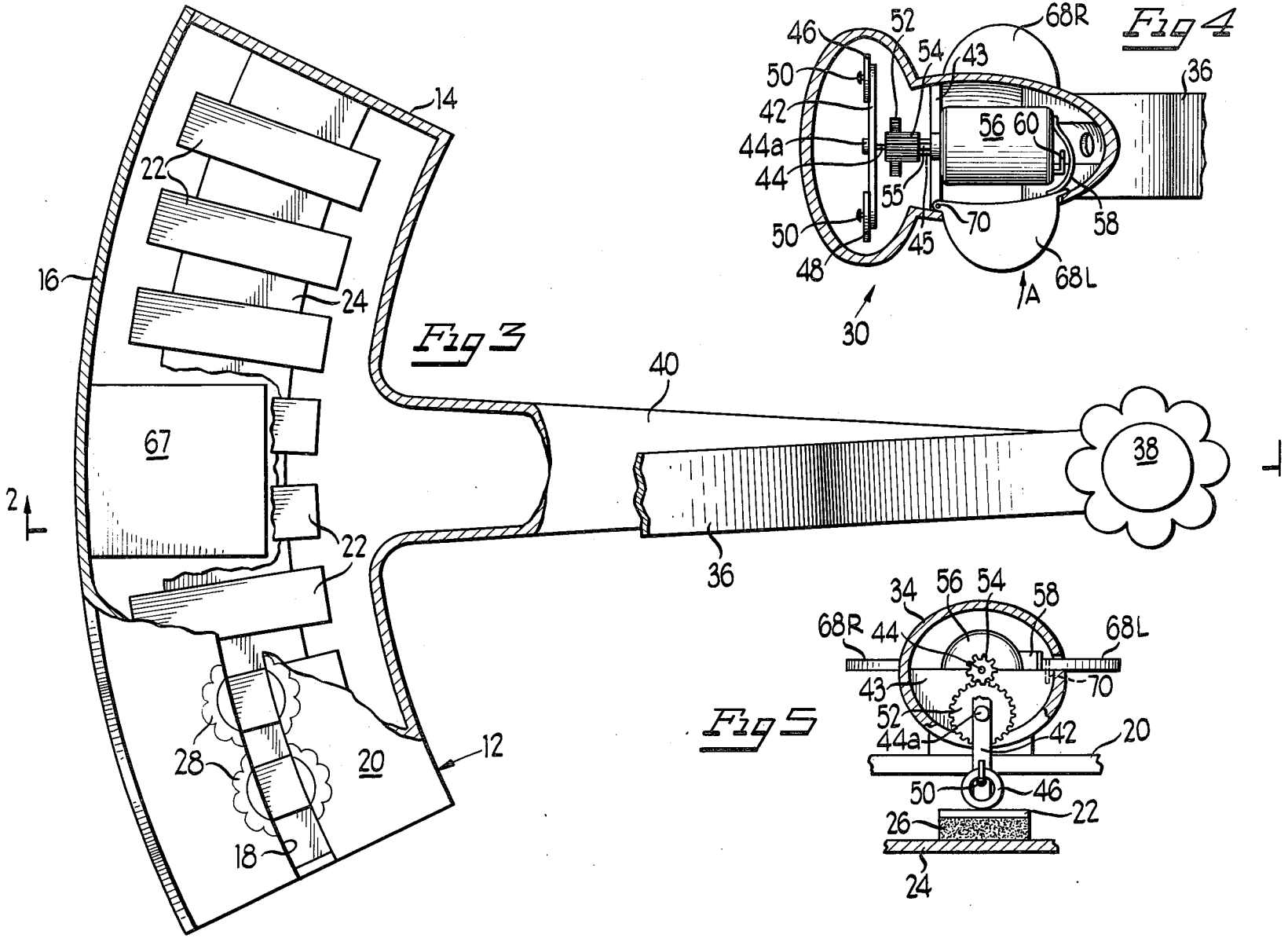
FIG. 3 is a horizontal, partially fragmented cross-sectional view taken along line 3—3 in FIG. 2.
FIG. 4 is a view of the body housing the striker taken along line 4—4 in FIG. 2.
FIG. 5 is a vertical cross-sectional view taken along line 5—5 in FIG. 2.

In the preferred embodiment, as discussed previously, the housing 34 is in the shape of an animated bumble bee and includes an enlarged, generally flattened head section (FIG. 4) which substantially encloses the rotatable striker arm assembly. In addition, the body portion of the housing is provided with a pair of wings 68R and 68L on the right and lefthand sides of the housing respectively. Referring to FIG. 4, the left wing 68L is pivotally connected to the body 34 by a pivot pin 70 on one end, while the other end is in engagement with the contact 58. Manual pivoting of the wing in the direction of arrow A will move the contact 58 into engagement with the contact 60, thus completing the electrical circuit with the battery 66 and energizing the motor 56. Upon energization of the motor, the striker arm 42 is rotated and the body may be manipulated and positioned over a selected tone bar 22 so that the washers 48 and 46 strike the tone bar producing a musical note. It will be noted, referring to FIG. 2, that the body portion 34 is mounted on the arm 36 so that the striker arm assembly is maintained at a predetermined distance relative to the tone bars 22 as the arm 36 engages the top wall 20 of the housing 12. The arm 36 may be flexed upwardly to skip over various tone bars as the bee 34 is moved between the various flowers 28. Alternatively, the arm 36 may bias the bee upwardly such that the downwardly pressure is required to cause the striker arm assembly 32 to contact the bars 22.

In the preferred embodiment, the flowers 28 on the top wall 20 are positioned directly above each of the tone bars 22 to provide means for aligning the striker with one of the tone bars 22. The back wall portion 16 is provided with a desirable graphic such as outdoor scenery which complies with the general theme of the musical toy 10. Of course, many other types of indicia or themes may be presented or used in conjunction with the present invention without departing from its true spirit and scope.

While only a single embodiment of the present invention has been shown it will be understood that while various changes and modifications may occur to those skilled in the art, it is contemplated by the appended to claims to cover all such changes and modifications as fall within the true spirit and scope of the present invention.

What is claimed as new and desired to be secured by Letters Patent of the United States is:

1. A musical toy, comprising:

a housing;

a plurality of tone bars mounted within the housing for producing a musical note upon being struck;

means for striking a selected tone bar to produce an audible signal, said striking means comprising a movable housing, drive means and a rotatable striker element connected thereto rotatably mounted within the movable housing;

means for energizing said drive means;

selectively operable switch means on said movable housing for selectively connecting said drive means to said energizing means; and means for guiding said striking means along a path of travel adjacent each of said tone bars, said guide means comprises an elongated portion of the housing having a pivot axis defined on the end thereof and a resilient connecting arm pivotally secured to said pivot axis at one end and secured to said movable housing on the other.

2. The musical toy of claim 1 including stop means defined on the housing between said housing and said movable housing to maintain said striking means at a predetermined relative position above a selected tone bar.

3. The musical toy of claim 2 wherein said housing includes a top wall portion for enclosing said tone bars therebeneath and an arcuate slot within said top wall, in alignment with said tone bars, to permit striking of the bars by the striking means.

4. The musical toy of claim 3 including indicia on the top wall in alignment with the tone bars to indicate the position to which the movable housing must be centered in order to strike a predetermined tone bar.

5. The musical toy of claim 4 wherein said indicia comprises a plurality of flowers.

6. The musical toy of claim 5 wherein said movable housing is formed in the configuration and shape of a bee so as to give the appearance of a bee gathering nectar from the flowers as the musical tones are produced.

7. The musical toy of claim 6 wherein said selectively operable switch means comprises a movable wing on the bee and a pair of contacts, one of said contacts being biased into engagement with the other of said contacts as the movable wing of the bee is depressed.

8. The musical toy of claim 7 wherein said drive means and energization means are connected to one another by leads traveling along the housing extension and the flexible arm for mounting the movable housing to thereby substantially reduce the weight of the housing and drive means.

* * * * *